US010741343B2

(12) United States Patent
Grillo

(10) Patent No.: US 10,741,343 B2
(45) **Date of Patent: *Aug. 11, 2020**

(54) KEYPAD DEVICE WITH ROCKER BUTTON MECHANISM

(71) Applicant: Google LLC, Mountain View, CA (US)

(72) Inventor: Jacobi Grillo, San Francisco, CA (US)

(73) Assignee: Google LLC, Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/284,225

(22) Filed: Feb. 25, 2019

(65) Prior Publication Data

US 2019/0189372 A1 Jun. 20, 2019

Related U.S. Application Data

(63) Continuation of application No. 15/800,012, filed on Oct. 31, 2017, now Pat. No. 10,276,324.

(51) Int. Cl.
*H01H 13/70* (2006.01)
*H01H 13/807* (2006.01)

(52) U.S. Cl.
CPC ..... *H01H 13/70* (2013.01); *H01H 13/807* (2013.01); *H01H 2205/002* (2013.01);
(Continued)

(58) Field of Classification Search
CPC ..... H01H 13/70; H01H 2205/002
(Continued)

(56) References Cited

U.S. PATENT DOCUMENTS 4,348,557 A * 9/1982 Sado ..... H01H 13/702 200/292
6,657,141 B1 * 12/2003 Myojin ..... H01H 25/008 200/4

(Continued)

FOREIGN PATENT DOCUMENTS

WO 2006067911 A1 6/2006
WO 2009133890 A1 11/2009

OTHER PUBLICATIONS

International Search Report and Written Opinion issued in PCT/US2018/040338, dated Nov. 12, 2018, 12 pages.

(Continued)

*Primary Examiner* — Edwin A. Leon
*Assistant Examiner* — Iman Malakooti
(74) *Attorney, Agent, or Firm* — Morris & Kamlay LLP

(57) ABSTRACT

A keypad device includes a circuit board having raised buttons disposed on a first surface of the circuit board, resilient switches disposed on a periphery of the first surface, and through-holes, wherein each of the raised buttons and switches, when actuated, closes a circuit on the circuit board and affects an input to the device. The keypad device includes a faceplate fastened to the circuit board, the faceplate having an array of openings configured to allow the buttons to pass through, bosses extending from a first surface of the faceplate toward the circuit board and positioned to pass through the through-holes on the circuit board, and plungers aligned above and in contact with the resilient switches such that when the plate is pressed toward the circuit board, in a region at or near a subject plunger, the subject plunger actuates the resilient switch that is in contact with the plunger.

19 Claims, 4 Drawing Sheets

(52) U.S. Cl.
CPC . *H01H 2215/004* (2013.01); *H01H 2219/036* (2013.01); *H01H 2221/012* (2013.01); *H01H 2221/032* (2013.01); *H01H 2221/082* (2013.01)

(58) Field of Classification Search
USPC ..... 200/5 A; 341/34; 349/169
See application file for complete search history.

(56) References Cited

U.S. PATENT DOCUMENTS

| | | | | |
|---|---|---|---|---|
| 7,084,360 | B2 * | 8/2006 | Schmidt | H01H 13/702 200/5 A |
| 2008/0316064 | A1 | 12/2008 | Wang | |
| 2011/0006928 | A1 * | 1/2011 | Kitagawa | G06F 1/1626 341/22 |
| 2011/0278146 | A1 * | 11/2011 | Zheng | H01H 13/705 200/5 A |
| 2012/0044660 | A1 | 2/2012 | Rappoport | |
| 2012/0228105 | A1 * | 9/2012 | Hsu | G06F 3/016 200/5 A |
| 2016/0055991 | A1 * | 2/2016 | Kropf | G07C 9/00944 200/5 A |

OTHER PUBLICATIONS

International Preliminary Report on Patentability for App No. PCT/US2018/040338, dated May 5, 2020, 8 pages.

* cited by examiner

100

110

110

KEYPAD DEVICE WITH ROCKER BUTTON MECHANISM

BACKGROUND

Various premises management systems (e.g., security systems, HVAC systems, etc.) include a panel or control device configured to receive input from users to control or set settings for the system. The device can include a numerical keypad and an LCD screen to display output. The device can include many mechanical parts that are prone to damage and deterioration over time.

BRIEF SUMMARY

According to an embodiment of the disclosed subject matter, a keypad device includes a circuit board having a plurality of raised buttons disposed on a first surface of the circuit board, a plurality of resilient switches disposed on a periphery of the first surface, and a plurality of through-holes, wherein each of the raised buttons and switches, when actuated, closes a circuit on the circuit board and affects an input to the keypad device. The keypad device further includes a faceplate fastened to the circuit board, the faceplate having an array of openings configured to allow the raised buttons to pass through, a plurality of bosses extending from a first surface of the faceplate toward the circuit board and positioned to pass through the plurality of through-holes on the circuit board, and a plurality of plungers aligned above and in contact with the resilient switches such that when the plate is pressed toward the circuit board, in a region at or near a subject plunger, the subject plunger actuates the resilient switch that is in contact with the plunger, wherein the faceplate is adjustably secured to the circuit board by screws inserted into the plurality of bosses through a second surface of the circuit board, opposite the first surface of the circuit board.

Additional features, advantages, and embodiments of the disclosed subject matter may be set forth or apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

DETAILED DESCRIPTION

Figure 1:
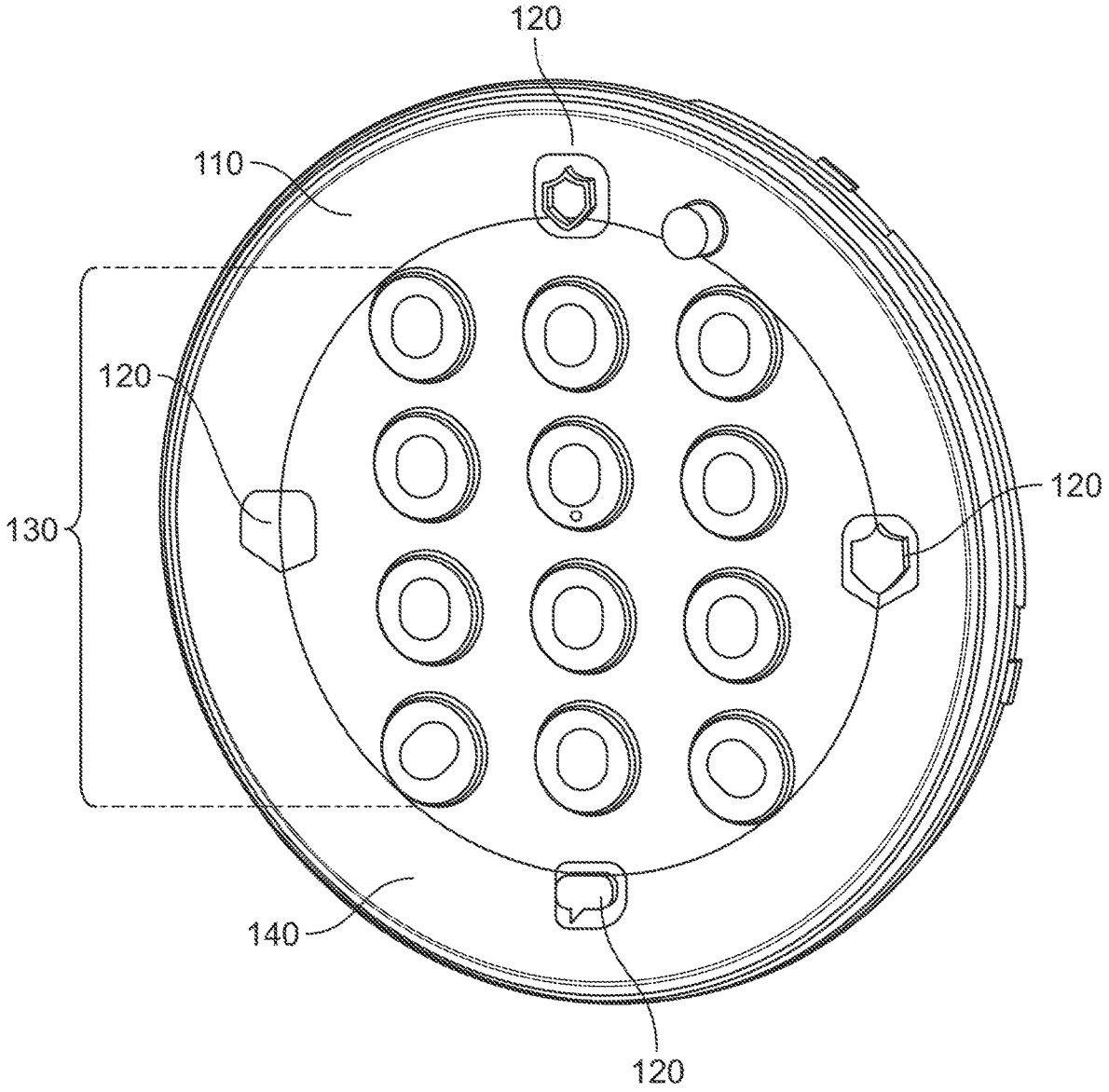
FIG. 1 shows a front perspective view of a keypad device according to an embodiment of the disclosed subject matter.

Various aspects or features of this disclosure are described with reference to the drawings, wherein like reference numerals are used to refer to like elements throughout. In this specification, numerous details are set forth in order to provide a thorough understanding of this disclosure. It should be understood, however, that certain aspects of disclosure may be practiced without these specific details, or with other methods, components, materials, etc. In other instances, well-known structures and devices are shown in block diagram form to facilitate describing the subject disclosure.

A keypad device having a rocker mechanism according to the disclosed subject matter includes a faceplate cover that functions as multi-directional rocker switch. Compared to conventional rocker mechanisms, the disclosed keypad device requires fewer parts to implement the rocker function, is simpler to manufacture, is less prone to wear and tear through use over time, and provides options for better illuminated indicators at depressible sections of the rocker.

FIG. 1 shows a front view of a keypad device 100 according to a disclosed embodiment. The device includes a faceplate 110 with a plurality of icons 120 marking depressible sections of the faceplate 110. In the embodiment shown, the faceplate 110 includes four icons, however this is merely a single embodiment, different numbers of icons/depressible sections can be implemented.

The faceplate 110 includes an array of openings which allow a plurality of buttons 130 to protrude through. Each of the buttons and depressible icons are positioned to actuate a switch in a circuit board beneath the faceplate 110 and thereby input data into the device 100, such as, for example, a passcode, a menu selection, or to change a parameter setting, as will be described further below.

To aid in facilitating use of the rocker function an outer edge 140 of faceplate can be formed to slant upward. This provides the user with a familiar, raised feel which indicates the availability of the rocker function, as well as enhancing the aesthetics of the device 100.

Figure 2:
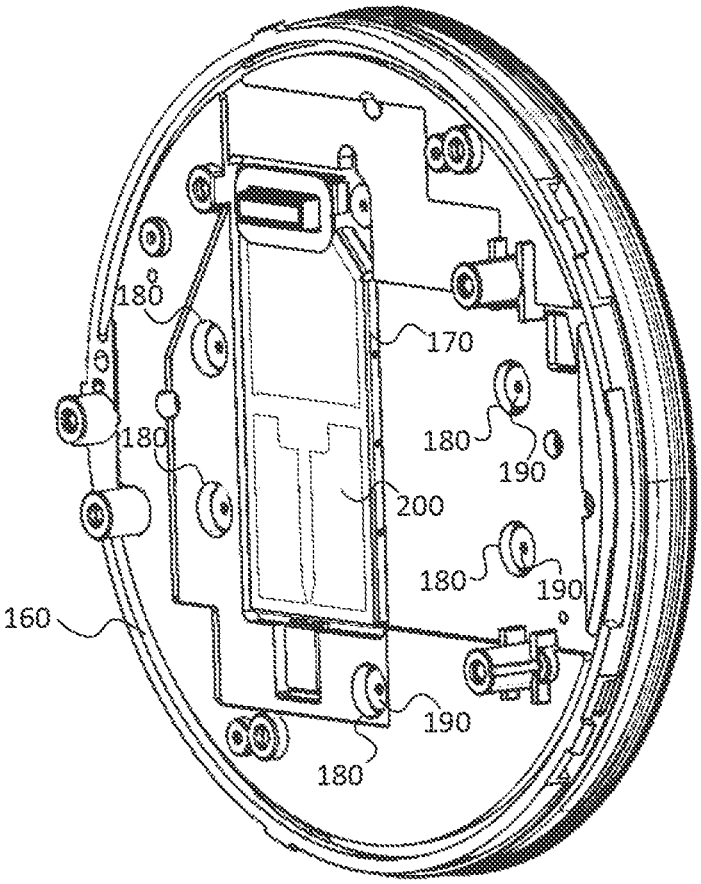
FIG. 2 shows a rear perspective view of a keypad device according to an embodiment of the disclosed subject matter.

FIG. 2 shows a rear view of the device 100. A housing 160 covers the rear and sides of the device. The housing 160 can include an opening 170 that provides access to one or more components of the circuit board 200 housed between the faceplate 110 and housing 160, e.g., a battery component, memory component, etc., that can be exchanged or upgraded. The housing 160 can include a plurality of openings 180 that provide access to adjusting screws 190 that can be used to fine tune the faceplate 110 for responsiveness, as will be explained below.

Figure 3A:
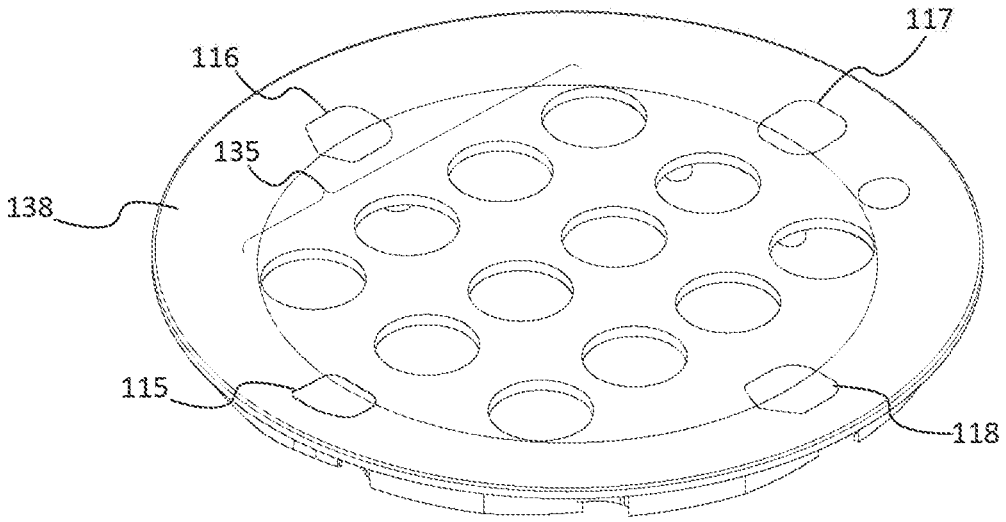
FIG. 3A shows a top perspective view of a faceplate according to an embodiment of the disclosed subject matter.

FIG. 3A shows a top side of the faceplate 110, detached from the device 100. The faceplate 110 can be constructed as a single, rigid, seamless component, including an array of openings 135 that allow buttons to protrude through and travel freely. The faceplate 110 includes a plurality of depressible portions 115, 116, 117, 118. In an embodiment the faceplate 110 includes a total of four depressible portions 115, 116, 117, 118 arranged in quarter positions around the periphery. In an embodiment the depressible portions are opaque and can be marked with an indicator to signify to the user the availability and location of the rocker function.

The use of a single, seamless faceplate reduces the complexity of construction of the device 100. It provides good cosmetics and is easy to manufacture as a single injection molded part. However, for some construction materials the inclusion of the array of openings 135 can weaken the faceplate 110 enough to increase a likelihood of the faceplate 110 flexing rather than remaining rigid when a depressible section is pressed. Such flexing can lead to increased wear and tear as well as detract from the high-quality presentation of the device. Accordingly, in some embodiments, an example of which is shown in FIG. 3A, a stiffening ridge 138 is disposed on the faceplate 110, surrounding the array of openings 135, to enhance a rigid quality of the faceplate 110.

Figure 3B:
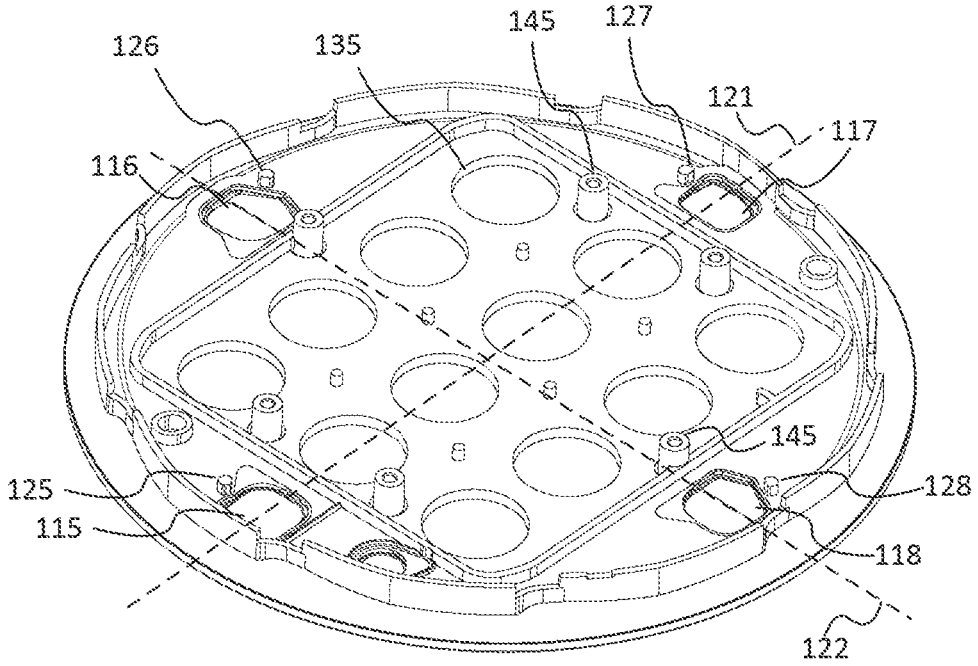
FIG. 3B shows a bottom perspective view of a faceplate according to an embodiment of the disclosed subject matter.

In the embodiment shown in FIGS. 3A and 3B, the depressible portions are translucent such that they allow at least some amount of light to pass through and which indicate which sections of the faceplate 110 can be depressed to utilize the rocker function. The translucent depressible portions 115, 116, 117, 118 can be aligned over one or more LEDs controlled by a processor connected to the circuit board 200. In this manner the device 100 can display one or more colors through the depressible portions 115, 116, 117, 118, e.g., according to a status or state of the device, or to indicate availability of certain features.

For example, in one mode of operation the device 100 can be configured such that one of the translucent depressible portions 115 is marked with an outline of a shield icon. A red light could indicate to a user that a security feature controlled by the device 100 is currently turned off. While in this state, the user can press the shield icon to activate the security feature. Upon activation the device processor can change the color displayed through the translucent depressible portion 115 from red to green, to indicate to the user that the security feature has been activated.

FIG. 3B shows a bottom side of the faceplate 110, detached from the device 100. The plurality of openings 135 are arranged in an array in a central area of the faceplate. The depressible portions 115 are positioned around the plurality of openings 135 along a peripheral area of the faceplate 110. In this embodiment, a first pair of depressible portions 115, 117 are positioned along a first alignment axis 121, each disposed on opposing sides of the faceplate 110. A second pair of depressible portions 116, 118 are positioned on opposing sides of a second alignment axis 122 that is perpendicular to the first alignment axis 121. Other embodiments may include a single depressible portion, three or more pairs of depressible portions disposed on opposing ends of respective alignment axis, or other configurations.

At each depressible portion 115, 116, 117, 118, within the immediate proximity a corresponding plunger 125, 126, 127, 128 is disposed on the bottom side of faceplate 110. When the faceplate 110 is secured to the circuit board 200, the plurality of plungers 125, 126, 127, 128 protrude from the bottom surface of the faceplate 110, each toward respective switches on the circuit board 200. Thus, when the top side of the faceplate 110 is pressed by a user, at or near a depressible portion, 115, 116, 117, 118, the faceplate 110 progresses toward the circuit board 200 and causes the corresponding plunger 125, 126, 127, 128 to actuate a switch on the circuit board 200.

In the embodiment shown in FIG. 3B, the plungers 125, 126, 127, 128 are positioned such that when pressure is applied at any depressible section near a subject plunger, i.e., to press the faceplate toward the board, only the switch in contact with the subject plunger is actuated while the remaining switches remain open.

A plurality of bosses 145 are disposed on the bottom side of the faceplate 110. Similar to the plurality of plungers 125, 126, 127, 128, each of the plurality of bosses protrude from the bottom surface of the faceplate 110 toward the circuit board 200.

Figures 4A, 4B:
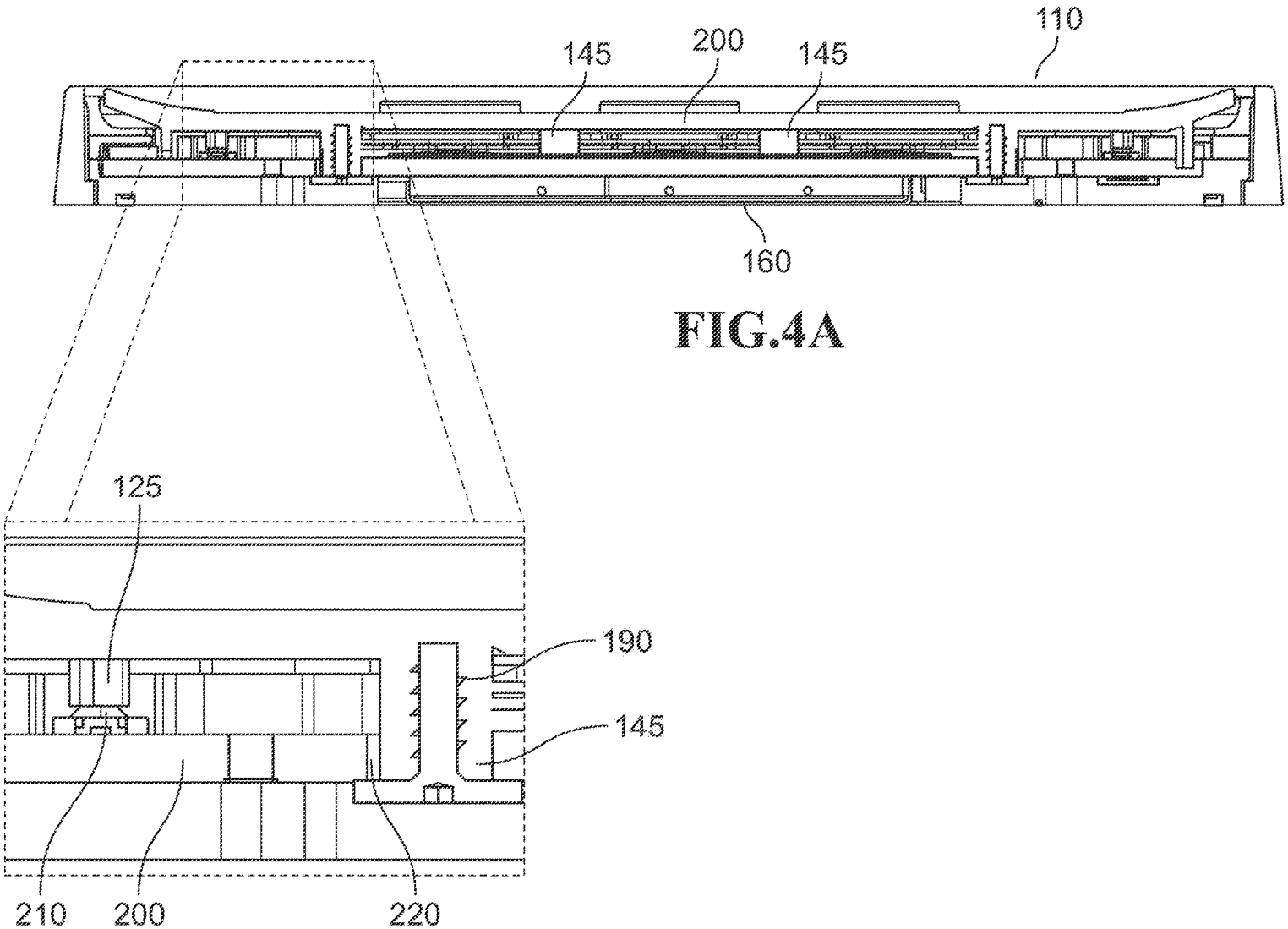
FIG. 4A shows a cut-away side view of a keypad device according to an embodiment of the disclosed subject matter.
FIG. 4B shows a magnified view of a cut-away side view of a keypad device according to an embodiment of the disclosed subject matter.

FIG. 4A shows a cutaway side view of the faceplate 110, circuit board 200 and housing 160. FIG. 4B shows a magnified view of a boss 145, adjustment screw 190, plunger 125, switch 210, and circuit board opening 220. As seen in the magnified view, the faceplate 110 is mounted above the circuit board 200 such that plunger 125 rests on top of and in contact with switch 210.

Switch 210 is a resilient switch that, when pressed, closes a circuit on the circuit board 200 and, when released, automatically returns to its original position. Switch 210 can be implemented as a dome-switch, as shown in FIG. 4, or as a different type of switch, such as a spring-loaded switch or other type of resilient switch that exerts an upward counter-force when pressed down.

The circuit board 200 includes an opening 220 for each faceplate boss 145. The faceplate boss 145 is positioned on the faceplate 110 to be aligned to protrude through the opening 220 when the faceplate 110 is placed over the circuit board 200. An adjusting screw 190 is inserted into the boss 145 to secure the faceplate 110 to the circuit board 200 and prevent the faceplate 110 from detaching from the circuit board 200 in an upward direction, i.e., away from the circuit board 200. However, the boss 145/screw 190 arrangement does not prevent the faceplate from moving in a downward direction, i.e., toward the circuit board 200.

In this arrangement, when the faceplate 110 is pressed at a depressible portion, that portion will descend toward the circuit board 200, driving the plunger 125 downward into the dome-switch 210. The depression actuates the switch 210, thereby closing a circuit on the circuit board 200 and affecting an input to the device 100. The resilient switch 210, upon being pressed down, exerts a counter-force upward to return to its initial state. Thus, when the user refrains from pressing the faceplate 110, the switch 210 forces the plunger 125, and by extension the faceplate 110, up to the faceplate's 110 original resting position.

The adjusting screw 190 can be tightened or loosened to tune the contact of the plunger 125 against the switch 210 at each depressible section of the face plate 110. The boss 145/screw 190 combination allows for fine tuning of responsiveness without requiring the use of shims or other additional parts normally used for tuning in a conventional rocker function apparatus.

In an embodiment the boss 145/screw 190 combination references the housing 160. In an alternate embodiment the boss 145/screw 190 combination references the circuit board 200 directly, thereby reducing the number of layers in the tolerance stack to a minimum compared to conventional rocker mechanisms which can include multiple layers in the tolerance stack, leading to a less consistent button feel in the rocker mechanism.

The disclosed keypad device provides an improved rocker function with a consistent feel and easily tunable features, as well as improved persistence against wear and tear. The disclosed keypad device with a rocker function can include a processor and a memory installed in the circuit board and be used to implement, for example, a security control system, HVAC control system, or a component of a premises management system wherein the central buttons are used for alphanumerical input and the peripheral depressible sections that provide the rocker function input are used to select menus, select operational modes, transmit a signal, change a device parameter such as color or sound, etc.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A keypad device, comprising:

a circuit board comprising:

a first switch;

a second switch;

a first button that actuates the first switch when depressed; and a faceplate comprising an opening and depressible independently of and without also depressing the first button, the faceplate actuating the second switch when depressed at a first position, wherein the first button extends at least partially through the opening in the faceplate.

2. The keypad device of claim 1, wherein the faceplate is further depressible at a plurality of positions.

3. The keypad device of claim 2, wherein each of the plurality of positions of the faceplate is depressible in a different radial direction than each other of the plurality of positions.

4. The keypad device of claim 1, wherein the second switch exerts a force on the faceplate to return the faceplate to an undepressed state.

5. The keypad device of claim 4, wherein the second switch exerts the force on the faceplate via a plunger in contact with the faceplate.

6. The keypad device of claim 1, wherein the second switch is a resilient switch or spring-loaded switch.

7. The keypad device of claim 1, further comprising:

an adjusting screw positioned to adjustably position the faceplate with reference to the circuit board.

8. The keypad device of claim 1, further comprising:

a first adjusting screw positioned to adjust the distance in which the faceplate may be depressed at the first position.

9. The keypad device of claim 8, further comprising:

a second adjusting screw positioned to adjust the distance in which the faceplate may be depressed at a second position.

10. The keypad device of claim 1, wherein the faceplate further comprises:

an icon positioned substantially proximate to the first position, such that depressing the icon actuates the second switch.

11. The keypad device of claim 10, wherein the circuit board further comprises:

a light-emitting device configured to illuminate the icon of the faceplate, the light-emitting device further configured to change the color of its illumination in response to the depressing the icon.

12. The keypad device of claim 1, wherein:

the circuit board further comprises:

a third switch; and the faceplate further comprises:

a first icon positioned substantially proximate to the first position, such that depressing the first icon actuates the second switch;

a second icon positioned substantially proximate to a second position such that depressing the second icon actuates the third switch, wherein depressing the first icon does not actuate the third switch and depressing the second icon does not actuate the second switch.

13. The keypad device of claim 1, wherein the circuit board further comprises:

a light-emitting device configured to illuminate a portion of the faceplate, the illumination of the light-emitting device indicating the availability of a feature in response to actuation of the second switch.

14. The keypad device of claim 13, wherein the portion of the faceplate further comprises:

an icon that represents a feature of the keypad device or a feature of a system communicably coupled to the keypad device.

15. The keypad device of claim 1, wherein the circuit board further comprises:

at least twelve buttons including the first button, each capable of being depressed independently of each of the other buttons.

16. The keypad device of claim 1, wherein the circuit board further comprises:

a light-emitting device configured to illuminate an icon indicating a status of a security feature controlled by the keypad device.

17. The keypad device of claim 1, wherein the circuit board further comprises:

a light-emitting device configured to illuminate a portion of the faceplate, the illumination of the light-emitting device indicating the state or status of the keypad device.

18. The keypad device of claim 1, wherein the first button is depressible independently of and without also depressing the faceplate.

19. The keypad device of claim 1, wherein the depressing the first button does not actuate the second switch and depressing the faceplate does not actuate the first switch.

* * * * *